United States Patent [19]

Reis

[11] 3,999,900

[45] Dec. 28, 1976

[54] PUMP WITH DISK-SHAPED PISTON FOR LIQUID OR GASEOUS FLUIDS

[75] Inventor: Fritz Reis, Worms, Germany

[73] Assignee: Balcke-Durr AG, Frankenthal, Germany

[22] Filed: Sept. 9, 1974

[21] Appl. No.: 504,382

[52] U.S. Cl. ..... 418/39; 418/53

[51] Int. Cl.[2] ..... F01C 1/02; F03C 3/00; F01C 21/00; F04C 1/02

[58] Field of Search ..... 418/49–53, 418/39; 73/258

[56] References Cited

UNITED STATES PATENTS

| | | | |
|---|---|---|---|
| 410,308 | 9/1889 | Bowns | 418/53 |
| 422,328 | 2/1890 | Ahlstrom | 418/53 |
| 676,656 | 6/1901 | Haas | 73/258 |
| 1,029,979 | 6/1912 | Ehrhart | 415/DIG. 3 |
| 1,200,521 | 10/1916 | Richards | 418/53 |
| 1,946,343 | 2/1934 | Wicha | 418/53 |
| 2,000,629 | 5/1935 | Wicha | 418/53 |
| 2,030,131 | 2/1936 | Wicha | 418/53 |
| 2,031,125 | 2/1936 | Peschl | 418/53 |
| 2,922,403 | 1/1960 | Russell | 418/53 |
| 2,992,635 | 7/1961 | Nasvytis | 418/53 |
| 3,040,664 | 6/1962 | Hartley | 418/39 |

FOREIGN PATENTS OR APPLICATIONS

| | | | |
|---|---|---|---|
| 340,111 | 12/1930 | United Kingdom | 418/39 |

*Primary Examiner*—John J. Vrablik
*Attorney, Agent, or Firm*—Bryan & Bollo

[57] ABSTRACT

A nutating pump of the type which has a rotatable shaft with a central member with an annular support groove at an angle to the shaft in which a disk is moveably supported and is restrained against rotation by a partition inserted in a radial slot in the disk, and has conial sections coaxial with the shaft and positioned on either side of the central member, the peripheral surface of the conic sections and the annular groove being at substantially the same angle with respect to the shaft. One such pump includes moveably replaceable central members and conic sections whereby the operating characteristics of the pump may be changed without having to replace the pump body. In another embodiment, a cylindrical insert is included in the radial slot in the disc, and grooves are included in the peripheral surfaces of the conic sections to receive the cylindrical insert as it passes over the surfaces of the conic section.

6 Claims, 7 Drawing Figures

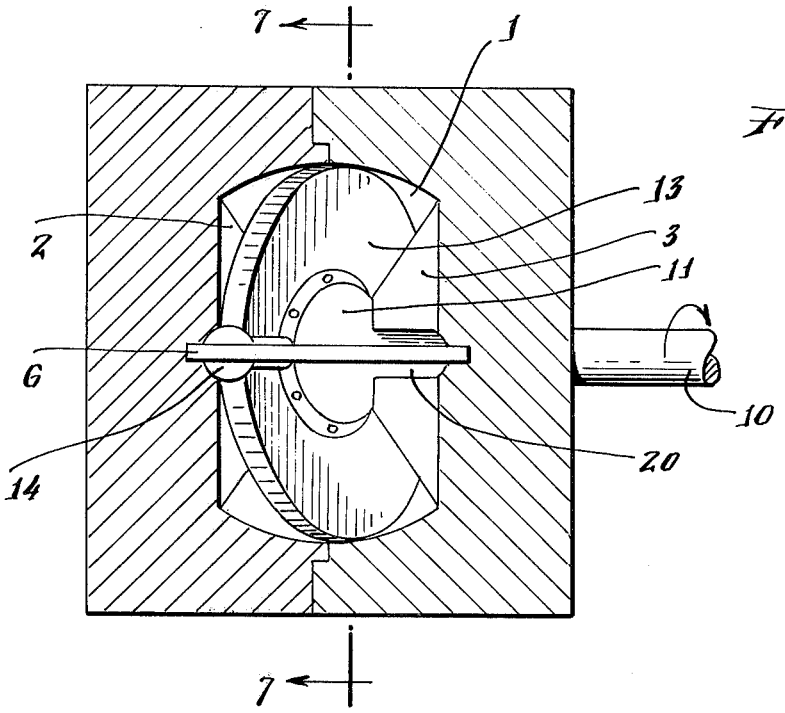
Fig. 5.
Fig. 6.
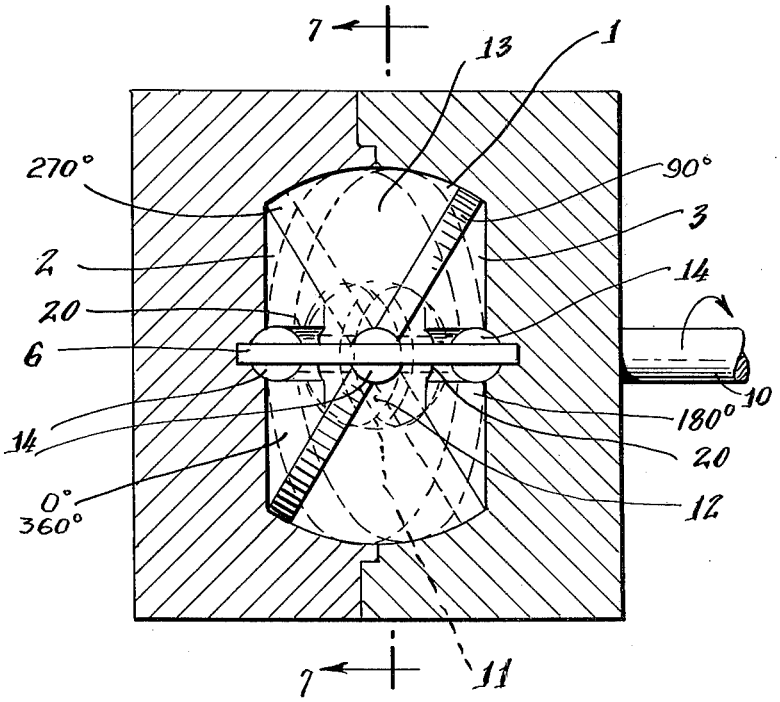

PUMP WITH DISK-SHAPED PISTON FOR LIQUID OR GASEOUS FLUIDS

The invention relates to a pump with disk-shaped piston for liquid or gaseous fluids, which, depending on the type of fluids to be handled, can be applied in pressure ranges in the order of 20 atmospheres.

Applications of pumps of the type, which is of interest here, are various. Mention may be made of fuel handling pumps or hydraulic pumps for generating operating pressures for fluids, furthermore of water pumps for domestic water supply or for the increase of pressure. Other examples are compressors for workshops, e.g. for filling stations for the inflation of tires.

Depending on the handling pressure and the flow rate and depending on the viscosity of the fluid to be handled, the average person skilled in the art can choose from a variety of designs of such pumps. Such well known types are, for instance, piston pumps, centrifugal pumps and radial flow and axial flow compressors, respectively, diaphragm pumps, gear pumps, rotary piston pumps and pumps with rotating screw.

Actually, piston pumps are well suited for achieving high pressures, in particular, when one thinks of multistage piston pumps, but they have the disadvantage of comprising too many individual parts and, in particular, they cannot do without valves; apart from that their size is too large considering the volumes handled, as due to the reciprocating masses of the pistons the speeds must be limited, if the life of the piston pumps is to be sufficient. If piston pumps are to be used for small volumes to be handled, the manufacture will require a high precision involving costs.

Pumps according to radial flow and axial flow compressor types have the advantages of a simple design and a good life, and they can also be manufactured for small and large capacities at rather low costs. Their disadvantage is only that the pressures and/or compression ratios which can be achieved, are low and usually do not exceed two to three atmospheres. A further disadvantage is that a reasonable efficiency will only be achieved at very high speeds so that in particular for gaseous fluids extensive aerodynamic tests have to be carried out with high costs involved. A further disadvantage of these pumps according to the radial or axial flow compressors designs is that though they can be used as recirculation pumps, e.g. in heating systems, they are, however, not self-priming pumps.

Diaphragm pumps are often used as small air pumps for ventilation of aquaria or for similar purposes. With small flow rates they are, therefore, only suitable for very small compression ratios. There are also diaphragm compressors with high pressure gains and large flow rates, also for liquid media, but the use of these compressors is limited to fields of application where the absence of glands has priority over the question of costs.

Gear pumps and pumps with rotating screws are not suitable for gaseous media, and for media with low viscosity such as water they are suitable only to a very limited degree. They have, therefore, only been used as oil and grease pumps. Thus, their main application is on the high pressure sector with low flow rates.

A pump type is, therefore, required which is suitable for a wide field of application with only minor constructional modifications.

In addition, the following must be said: Firstly, now and again there is a requirement for pumps or compressors to change the direction of handling, and there are only few types of pumps and compressors where this is possible. Secondly, pumps or compressors will frequently be used as drives for hydraulic motors or air motors, and the manufacture of such units is considerably facilitated, if the same unit could be used both as a pump or compressor and as a mover.

It is therefore the object to provide a pump or compressor type which is suitable for a wide field of application with only slight constructional changes, the handling direction of which can be changed by changing the direction of drive, and which can additionally be used as a motor.

This object is achieved for a self-priming pump with disk-shaped piston in a pump chamber and a rotating shaft for liquid and gaseous media by the pump chamber being shaped as a hollow sphere in which conic frustums arranged opposite to each other are inserted; by the rotating shaft being concentrically inserted into the conic frustums and being provided with a sphere, which is rigidly connected to the rotating shaft, slidingly rests against the frontal faces of the conic frustums, and is provided with a groove, which is arranged on a plane inclined against the shaft in an angle other than 90°; by the disk-shaped piston being concentrically and slidingly supported in this groove, the diameter of the disk-shaped piston corresponding to the diameter of the pump chamber; by the disk-shaped piston being provided with a radially extending groove, which slidingly embraces the lateral surfaces of a dividing wall rigidly inserted in the upper part of the pump chamber and cut out at the bottom in the form of a circular arc and extending down to the sphere; by the pump chamber in the upper part being provided on both sides of the dividing wall with openings for the connection of the suction and the discharge lines; and by dimensioning the conic frustums in such a manner that they form rolling surfaces for the frontal faces of the disk-shaped piston.

It is of advantage, if in the radially extending groove or the disk-shaped piston a cylindrical guide roller is slidingly inserted, which is provided with a parallel groove, the lateral walls of which slidingly embrace the dividing wall.

Now, when the rotating shaft rotates, the sphere provided with a groove must follow this rotating movement. The disk-shaped piston, however, cannot do so, as its radial groove and the cylindrical guide roller, respectively, slide along the dividing wall. As a consequence, the disk-shaped piston carries out a wobbling movement, which causes the disk-shaped piston to push the fluid to be handled forward in front of it from the suction side up to the discharge side. If one looks on the frontal face of the rotating shaft, and if the shaft is then rotating clockwise, the fluid to be handled is sucked in at the left hand part of the pump casing and is discharged at the right hand part of the pump casing. The direction of handling of the pump can, therefore, be changed by simply reversing the sense of rotation.

Valves are not required, as the outside wall of the disk-shaped piston slides along the hollow sphere part of the pump chamber, and the frontal faces of the piston roll off on the conic frustum-shaped inserts. When using liquid media, thin liquid layers are formed on the sliding and rolling surfaces between the disk-shaped piston and the pump chamber. These layers firstly provide lubrication and secondly sealing, so that special measures for sealing and lubrication are not required. If necessary, the rim of the disk-shaped piston can be equipped with a labyrinth gland or with piston rings.

The characteristic of a pump according to the invention, that is to say the inter-relationship between the flow rate and the discharge pressure with a predetermined driving capacity and a predetermined diameter of the disk-shaped piston, can be changed in a simple way. One has only to change the inclination of the groove in the sphere, in which the disk-shaped piston slides. The manufacturer has only to keep on stock spheres with grooves of different inclination and the associated conic frustums. All other components of the pump need not be changed. The adaption to different viscosities is possible in the same way.

A further advantage of a pump according to the invention is that the driving speed is not critical. It can be driven, for instance, at a speed of 3000 revolutions per minute, which is not possible for piston pumps. One can, therefore, use simple and inexpensive electric motors as drives and save reduction gears. Nevertheless, the efficiency of a pump in accordance with the invention is sufficiently good, even with low speeds.

The following more detailed explanation of the invention, in particular in the figures, is mainly concentrated on the geometry and on the course of the movements, as the average person skilled in the art can find several possible ways to realize this geometry and these movements.

FIG. 5 shows a perspective view of a pump according to the invention

FIG. 6 shows four different piston positions.

Figure 1:
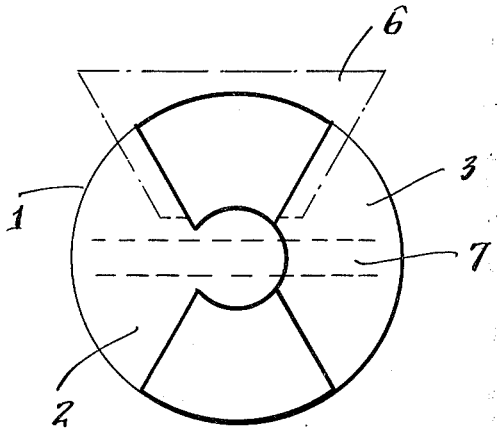
FIGS. 1 and 2 show the geometry of the pump chamber.
Figure 2:
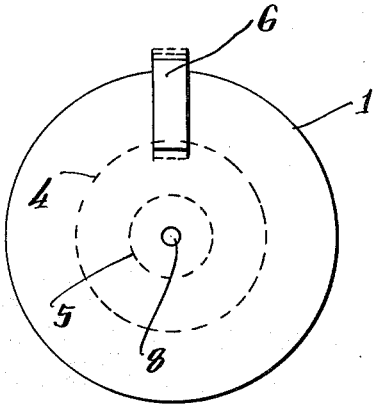

In FIGS. 1 and 2 the circular line 1 represents the inside wall of the hollow spherical pump chamber. The segments 2 and 3 in FIG. 1 are conic frustum-shaped inserts. The contours of the upper and lower frontal faces of these inserts are shown in FIG. 2 as dotted circular lines 4 and 5. The reference numeral 6 indicates a dividing wall which is rigidly inserted into the pump casing. 7 and 8 are bores, into which a shaft can be inserted. The detailed construction of the pump casing is not shown, as there are many constructional possibilities of making a pump casing, the pump chamber of which corresponds to the geometry of the FIGS. 1 and 2.

Figure 3:
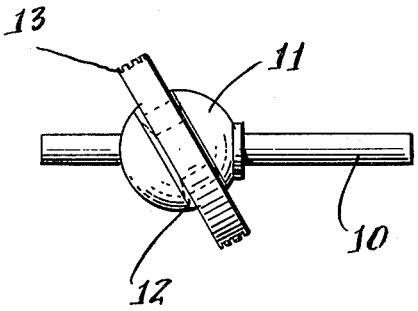
FIG. 3 shows the driving shaft with the sphere and the disk-shaped piston

FIG. 3 shows a further essential component of a pump according to the invention. A sphere 11 is rigidly attached to a shaft 10. The sphere 11 can, for instance, be keyed on the shaft. The sphere 11 has on its circumference a groove 12, which is inclined against the axis of shaft 10 at an angle other than 90°. Preferably this angle of inclination is to be not smaller than 60°. In the groove 12 a disk-shaped piston 13 is slidingly arranged; at the rim of this disk-shaped piston there are grooves forming a labyrinth gland.

Here, too, it is not essential for the invention, how the shaft, the sphere and the disk-shaped piston are made up in detail. The disk-shaped piston 13, for instance, can be made of one piece. In that case the sphere 11 will be made from two parts, so that an assembly will be possible. But the sphere can also be of one-piece type. Then, the disk-shaped piston will be made from two parts.

The average person skilled in the art will known of which materials the sphere 11 and the disk-shaped piston 13 can be made, so that they show both sufficient resistance to wear and the necessary sliding properties. Thus, as an example, the sphere 11 may be made of steel with the surface nitrided, and the disk-shaped piston 13 may be made of non-ferrous metal. There is also no difficulty in the selection from various steel qualities for the sphere 11 and the disk-shaped piston 13. Numerous plastic materials will also be suitable, such as Teflon, certain polyolefines, Teflon or Nylon 6 or 12.

Figure 4:
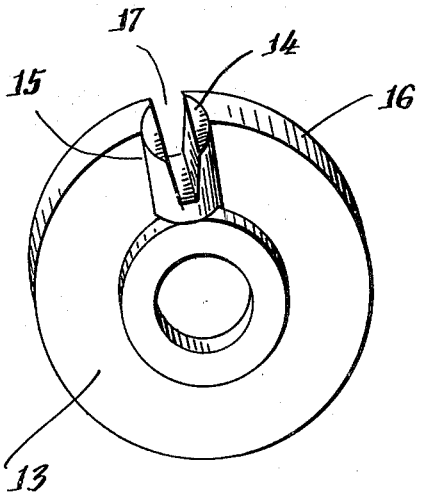
FIG. 4 shows the disk-shaped piston with the cylindrical guide-roller
Figure 7:
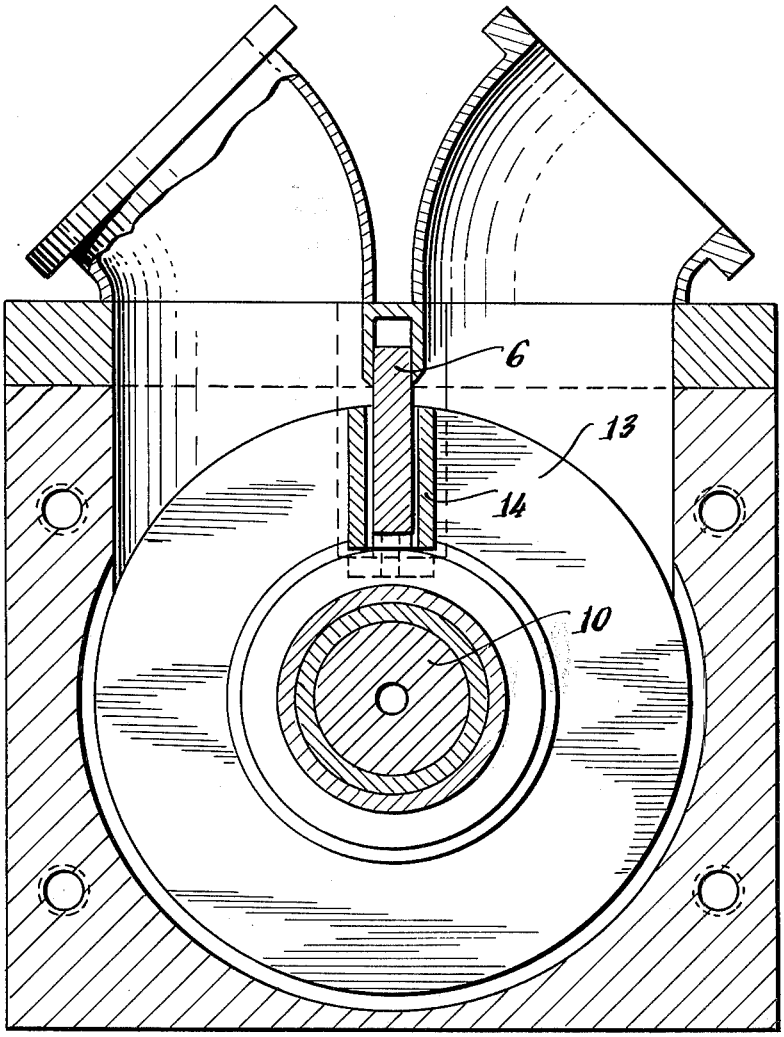
FIG. 7 is a sectional view taken along lines 7—7 of FIGS. 5 and 6 showing the suction and delivery openings.

FIG. 4 shows the disk-shaped piston 13 with a cylindrical guide roller 14, which is slidingly inserted into a groove 15 with walls of a hollow cylinder form. This cylindrical guide roller 14 shows in turn a groove 17 with parallel side walls, into which the dividing wall 6 engages, when the pump is assembled.

The outside wall 16 of the disk-shaped piston 13 can be provided with grooves forming a labyrinth gland. It can, however, also be provided with piston rings (not shown).

FIG. 5 shows a perspective plan view of the pump according to the invention, with the suction port and the delivery port removed. The reference numerals used correspond to those used in the FIGS. 1 to 4, so that no further explanation is required.

The following components of the pump according to the present invention are shown: The spherical pump chamber 1, the conic frustum-shaped inserts 2 and 3, the shaft 10, the sphere 11, the disk-shaped piston 13, the guide roller 14 and the dividing wall 6.

The conic frustum-shaped insert 3 has been provided with a recess 20, which receives the guide roller 14 during the rolling-off of the disk-shaped piston 13. The conic frustum-shaped insert 2 has also such a recess.

In FIG. 6 the positions of the disk-shaped piston 13 within the pump chamber are shown for angles of rotation of the driving shaft 10 at 0°, 90°, 180°, 270°. Assuming that in the 0° — position the piston 13 takes a position, in which the guide roller 14 is in the recess 20 in the conic frustum-shaped insert 2, it can be seen that in the 90° and 270° positions the guide roller is arranged exactly in the middle of the dividing wall 6, and only the rim of the disk-shaped piston 13 is visible. In the 0° and 180° positions, however, one looks obliquely on the frontal faces of the disk-shaped piston 13.

In FIG. 6 the direction of view is the same as in FIG. 5, and also the reference numerals are the same.

It is stressed again that the geometry and the kinematics of the motions are considered essential, and therefore the description of constructional details has been largely omitted, as the average person skilled in the art will be in a position to find constructional solutions to realize the courses of these motions.

I claim:

1. A device for causing the transfer of motion between fluids and a drive shaft comprising:

a central chamber inside a housing into which coaxial conic frustums project with their tops facing each other in spaced-apart relationship, a drive shaft which passes through, is supported by, and is coaxial with said conic frustums, a member positioned between the tops of said conic frustums in moveable contact therewith and affixed to said shaft, a circular piston disk extending to the walls of said chamber with its flat surfaces in linear contact with the lateral surfaces of said conic frustums and being moveably mounted in a circular groove in the outside of said member, which groove is at an angle of other than 90° with respect to the axis of said shaft and is at substantially the same angle to said axis of said shaft as the angle between said axis and said lateral surface of said conic frustums, said disk having a radial slot wherein a cylindrical guide roller having a diameter larger than the thickness of said disk is inserted, said roller having an axially-oriented groove whose lateral walls slidingly embrace the walls of a partition which is affixed to the wall of said chamber and extends therefrom to moveably contact the surface of said member by means of which partition inlet and outlet paths to said chamber are defined and said disk is prevented from rotating with respect to said housing, each of said conic frustums having a straight surface groove positioned at the intercept of the plane of said partitions with the surface of said frustum, which groove is of substantially the same depth as the distance by which said roller extends above the surface of the disk facing said frustum and wherein said roller will be accommodated when said disk is in contact with the surface of said frustum at said intercept, said member being removeably affixed to said shaft and said conic sections being removeably affixed to said housing.

2. The device described in claim 1 including means external to said housing for causing said shaft to rotate whereby said device may be made to function as a hydraulic pump.

3. The device described in claim 1 including means external to said housing for causing hydraulic fluid to flow into said inlet path whereby said energy conversion device is to function as a hydraulic motor.

4. The device described in claim 1 wherein said member is a sphere.

5. The device described in claim 4 including means external to said housing for causing said shaft to rotate whereby said device may be made to function as a hydraulic pump.

6. The device described in claim 4 including means external to said housing for causing hydraulic fluid to flow into said inlet path whereby said energy conversion device is to function as a hydraulic motor.

* * * * *